United States Patent [19]

O'Connor

[11] Patent Number: 5,026,206

[45] Date of Patent: Jun. 25, 1991

[54] PAVEMENT AND BASE RECYCLE METHOD AND APPARATUS

[76] Inventor: Patrick L. O'Connor, 4343 Hough Rd., Dryden, Mich. 48428

[21] Appl. No.: 501,876

[22] Filed: Mar. 30, 1990

[51] Int. Cl.[5] ..... E01C 7/06

[52] U.S. Cl. ..... 404/77; 404/91

[58] Field of Search ..... 404/77, 79-81, 404/72, 91, 92, 95, 101, 108, 109, 110, 111

[56] References Cited

U.S. PATENT DOCUMENTS

| | | | |
|---|---|---|---|
| 2,064,365 | 12/1936 | Wallace | 404/92 |
| 2,619,013 | 11/1952 | McEachran | 404/92 |
| 3,843,274 | 10/1974 | Gutman et al. | 404/91 |
| 4,011,023 | 3/1977 | Cutler | 404/91 |
| 4,037,981 | 7/1977 | Wirtgen | 404/91 |
| 4,226,552 | 10/1980 | Moench | 404/92 |
| 4,272,212 | 6/1981 | Bauer, Jr. et al. | 404/72 |
| 4,317,642 | 3/1982 | Wirtgen | 404/72 |
| 4,335,974 | 6/1982 | Wirtgen | 404/92 |
| 4,407,605 | 10/1983 | Wirtgen | 404/77 |
| 4,453,856 | 6/1984 | Chiostri et al. | 404/91 |
| 4,473,320 | 9/1984 | Register | 404/91 |
| 4,511,284 | 4/1985 | Sterner | 404/108 X |
| 4,557,626 | 12/1985 | McKay et al. | 404/112 X |
| 4,640,644 | 2/1987 | Puchala et al. | 404/75 |
| 4,676,688 | 6/1987 | Caradot | 404/91 |
| 4,676,689 | 6/1987 | Yant | 404/95 X |
| 4,678,363 | 7/1987 | Sterner | 404/92 X |
| 4,682,909 | 7/1987 | Mihara | 404/90 |
| 4,784,518 | 11/1988 | Cutler | 404/79 |
| 4,793,730 | 12/1988 | Butch | 404/77 |
| 4,815,891 | 3/1989 | O'Connor | 404/77 |
| 4,820,078 | 4/1989 | Brocious | 404/92 |
| 4,850,740 | 7/1989 | Wiley | 404/79 |
| 4,929,120 | 5/1990 | Wiley et al. | 404/77 |
| 4,944,631 | 7/1990 | Egli | 404/91 |
| 4,946,307 | 8/1990 | Jakob | 404/91 |

*Primary Examiner*—Ramon S. Britts
*Assistant Examiner*—Gay Ann Spahn
*Attorney, Agent, or Firm*—Basile and Hanlon

[57] ABSTRACT

A method and apparatus for repairing a utility cut in a section of pavement is provided. The method includes the steps of transferring broken pavement and underlying base material from the utility cut, mixing the transferred material with predetermined quantities of water and binder material to form a fluid, unshrinkable, settable filler mixture which is then reapplied to the utility cut. The filler mixture hardens to a set state in a short period of time. All of the operative elements of the apparatus for performing the method are arranged for use directly at the utility cut site. An optional crusher for reducing larger excavated particles to a smaller size and a heater for heating the filler material reapplied to the utility cut may also be employed. Further, the removed material may be separated according to size to exclude particles above a predetermined size. Finally, a suction pump may be employed to remove water from, below or above the filler material after the filler material has been applied to the utility cut.

24 Claims, 1 Drawing Sheet

PAVEMENT AND BASE RECYCLE METHOD AND APPARATUS

BACKGROUND OF THE INVENTION

Field of the invention

The present invention relates, in general, to methods and apparatus for repairing openings in and immediately below a section of road or sidewalk pavement and, more specifically, to methods and apparatus for recycling pavement and base material in and immediately below an opening in a section of pavement back into the opening.

Cuts in the form of deep trenches are commonly made by utility companies in the pavements of roads and sidewalks to insert or repair underground utility lines. Problems with inadequately repaired or filled utility cuts frequently result in weakened sections of pavement which greatly reduces the useful life of such surfaces or requires the need for additional and costly repairs. All of these factors contribute to high road repair costs.

Various attempts have been made to devise methods and apparatus to address and overcome these problems associated with utility cut repairs in sections of pavement. Since merely replacing the excavated pavement material into the utility cut has resulted in an inadequate repair due to improper compaction, lack of pavement cutback, etc., filler material has been mixed with the excavated material to improve its characteristics in repairing utility cuts. This requires removal of the excavated material to a remote site for mixing with the filler material and the subsequent transport of the filler mixture back to the utility cut site. Such transport of material back and forth adds a significant amount to the cost of road repairs.

It has also been known to mix excavated material with a filler or new material utility cut site. Single or multiple vehicles are employed at the utility cut site to remove and mix excavated material from a road surface with sufficient quantities of filler material or new, fresh material before restoring the mixture to the utility cut. Still, a considerable length of time (i.e., 24 hours) is required for the restored material to set to a hardened state sufficient to carry loads. In addition, the asphalt or concrete pavement that has been broken out is not reused and must be removed from the site for disposal.

U.S. Pat. No. 4,815,819, filed in the name of the inventor of the present invention, overcomes the lengthy set-up time of such filler materials by filling the utility cut with a fluid, unshrinkable, settable, sub-grade base filler material to a desired depth below grade level and then heating the filler material to speed up the setting of the filler material in the utility cut to a hardened state within minutes instead of days. This enables a top layer of new asphalt or concrete to be immediately placed in the utility cut to complete the repair. However, this method still requires multiple vehicles to make a flowable backfill material for the utility cut which contribute to high repair costs. In addition, the filler material described in this patent is formed off site or away from the utility cut which again adds to repair costs and total repair time. What is needed is an in situ or at the site method and apparatus for removing, separating, mixing and reapplying a fluid filler material to a utility cut which can be performed directly at the utility cut site.

Other road repair and resurfacing methods and apparatus, typically those involving the repair of asphalt road surfaces, make use of single or multiple vehicles to remove the one to four inches of surface topcoat, to mix the removed material with a new coating material or fresh asphalt, and then to reapply the recycled and mixed material onto the road surface where it is heated and compressed by other vehicles and machines. However, such vehicles only remove the top few inches of the pavement and the underlying pavement bed and have not been devised for use with deep utility cuts extending three feet or more into the ground and which involve significantly greater amounts of rock, dirt, etc.

The pavement repair art is lacking a method or apparatus with combined means for performing all of the above-listed functions in repairing a utility cut in a section of pavement directly at the utility cut site by filling the utility cut with a fluid, unshrinkable, filler material which comprises a mixture of water, cement, flyash or the like, excavated material and/or the broken out asphalt or concrete surface material from the utility cut.

Thus, it would be desirable to provide a method and apparatus for removing, forming and reapplying a fluid, base material to a utility cut which is done directly at the utility cut site. It would be desirable to provide a method and apparatus in which all of the functions of removing, separating, mixing and restoring material to a utility cut is performed on one vehicle directly at the utility cut site. It would also be desirable to provide a method and apparatus for repairing a utility cut in a section of pavement which makes complete use of all of the material excavated from the utility cut.

SUMMARY OF THE INVENTION

The present invention is a method and apparatus for excavating and refilling a utility cut in a section of pavement. The components of the apparatus for performing the present method are arranged and employed so as to enable the excavating, mixing and refilling of the utility cut to be done directly at the utility cut site.

The method of excavating and refilling an opening in a section of pavement and through the underlying pavement base material in a single, movable vehicle comprises the steps of:

(a) transferring a quantity of broken pavement and underlying base material to a predetermined level below the pavement grade level;

(b) optionally separating the transferred material to exclude particles above a predetermined size;

(c) mixing the separated material of a predetermined small size with predetermined quantities of water and a binder material to form a fluid, unshrinkable, settable filler mixture; and (d) applying the filler mixture to the opening in the section of pavement and allowing the filler mixture to harden to a set state.

Step (a) also encompasses transferring material from a pile adjacent to the opening which has been excavated.

Optionally, the method may include the step of crushing particles larger than the predetermined small particle size to a size less than the predetermined particle size. Further, the filler mixture applied to the opening in the section of pavement may be heated to hasten the setting time of the filler mixture to a hardened state.

In a preferred, although not essential embodiment, all of the steps (a) through (d) are performed on a single movable vehicle directly at the utility cut site. Further, water is removed from the filler material after the filler material has been applied to the opening, such as by a pump, to hasten the set-up time of the filler material.

The apparatus for performing the method of the present invention includes means for transferring broken pavement and underlying base material to a predetermined level below the pavement grade level from an opening in a section of pavement or from a pile of previously excavated material. Means may also be mounted on a vehicle, such as a motor-driven truck chassis or a towed trailer for separating the transferred material according to size so as to select only particles having less than a predetermined size. Hopper means are mounted on the vehicle for storing the transferred or separated material of a predetermined small size. The material in the hopper is mixed in a mixing means with predetermined quantities of water and a binder material, such as cement, or flyash or the like to form a fluid, unshrinkable, settable filler material. Means disposed in communication with the mixing means is provided for applying the fluid filler mixture to the excavated opening in the section of pavement a predetermined level below grade or temporarily to grade level.

In one embodiment, the transferring means, the separating means, the hopper means, the mixing means and the applying means are all mounted on a single, movable vehicle.

The transferring means preferably comprises a vacuum source mounted on the vehicle which is operatively connected to an elongated hose for drawing broken pavement and underlying pavement base material via suction into the separating means. The transferring means could also be a clam shell or scoop-type shovel mounted on a hydraulic boom. The separating means, in a preferred embodiment, comprises a vibrating screen mounted within a bin or chamber on the vehicle. The screen has a predetermined opening or mesh size to allow particles less than a predetermined size to pass freely therethrough. Larger particles are diverted to the bottom of the bin. A conveyor is mounted within the bin and transports the separated particles of less then the predetermined maximum size to the hopper means. The hopper means temporarily stores the separated, excavated material. Separate tanks containing water and cement are mounted on the vehicle and connected to a mixing means, such as a pug mill, also mounted on the vehicle and connected in communication with the hopper to mix predetermined quantities of water and binder material which are applied to the pug mill via suitable controls and valves. This forms a fluid, unshrinkable, settable filler material which is applied through a discharge nozzle into the utility cut.

The nature of the fluid, filler material is such that the filler material hardens to a set state capable of 100% self-compaction. Thus, future repairs due to lack of adequate compaction of the filler material are not required.

The apparatus of the present invention may optionally include a crusher in the form of opposed, movable jaws which is located below the vibrating screen. The jaws crush the larger particles on the top of the vibrating screen and reduce such particles to a desired smaller size. Such crushed particles are transported by a second conveyor to the primary conveyor in the bin for transport to the hopper.

The apparatus of the present invention may also include a heater mounted directly on the vehicle itself or towed in a separate trailer attached to the vehicle for applying heat directly to the filler material restored to the utility cut to hasten the setting time of the filler material to a hardened state. Finally, a pump may be employed to remove water from the filler material after the filler material has been applied to the opening in the pavement.

The method and apparatus of the present invention provides quick and easy refilling of utility cuts in sections of pavement within the same day. This eliminates the multiple days that previously repaired utility cuts required for full compaction. The method and apparatus of the present invention performs all of the necessary excavation and base installation functions of a utility cut repair directly at the utility cut site to minimize transport and pavement repair costs. The use of the filler material to restore the utility cut provides a high quality pavement repair having sufficient strength to prolong the useful life of the pavement and most of all self-compacting without any mechanical means of tamping. Finally, the filler material is capable of 100% self-compaction which conserves resources, requires no dumping of excavated material or the use of additional new material, except relatively small quantities of water and binder material, and eliminates future repairs caused by lack of compaction.

BRIEF DESCRIPTION OF THE DRAWING

The various features, advantages and other uses of the present invention will become more apparent by referring to the followed detailed description and drawing in which.

DESCRIPTION OF THE PREFERRED EMBODIMENTS

Figure 1:
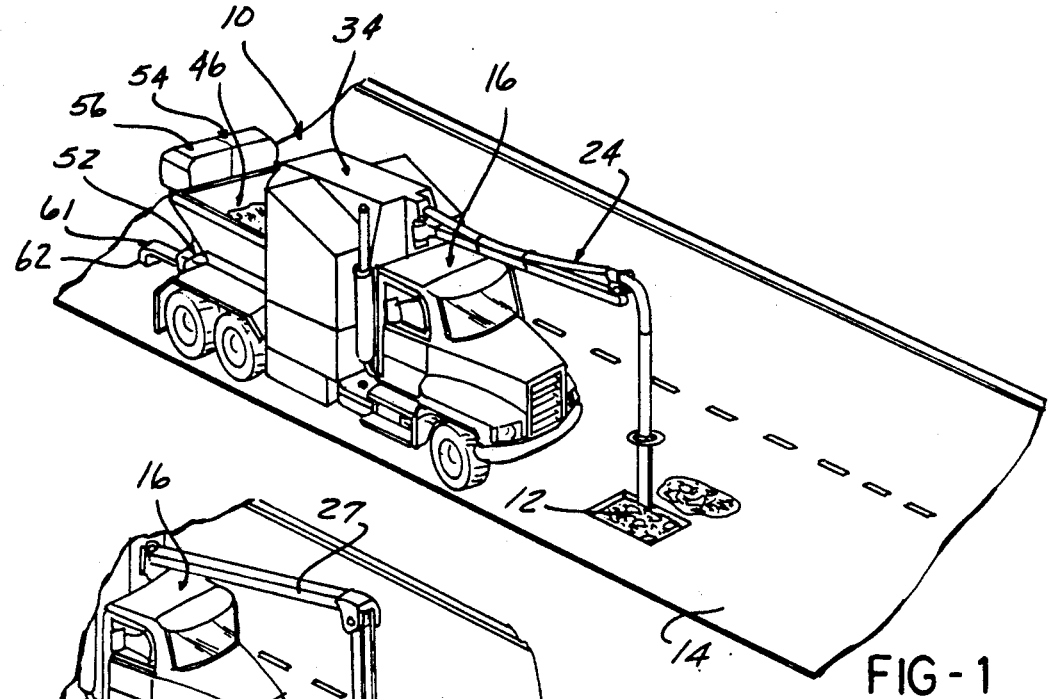
FIG. 1 is a perspective view of an apparatus for repairing utility cuts in sections of pavement which is constructed in accordance with the teachings of the present invention.

Throughout the following description and drawing, an identical reference number is used to refer to the same component shown in multiple figures of the drawing.

Referring now to the drawing, and to FIG. 1 in particular, there is illustrated an apparatus 10 for refilling or backfilling a utility cut 12 formed in a section of pavement, such as a road, sidewalk, etc. Although a single vehicle is depicted in the drawing as containing all of the operative components of the apparatus 10, it will be understood that certain of the components may be mounted on different, separate vehicles or independently transported to and employed at the utility cut 12. The important feature of the present invention is that all of the steps described below are performed directly at the utility cut 12.

Figure 2:
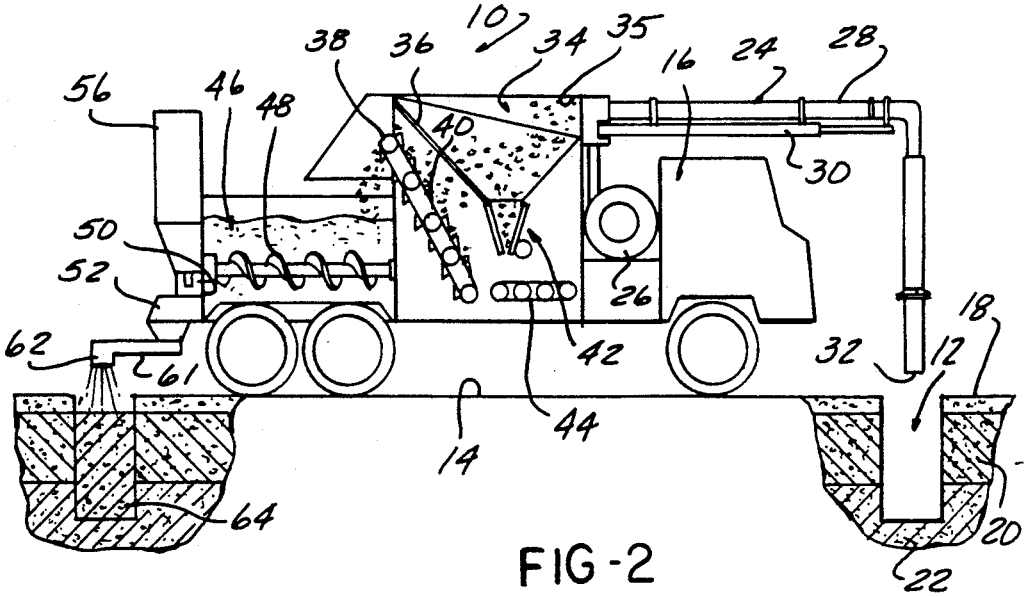
FIG. 2 is a partially sectioned, side elevational view of the apparatus shown in FIG. 1.

The details of the apparatus 10 are depicted in FIGS. 1 and 2. The apparatus 10 preferably, but not exclusively, comprise a single vehicle 16, such as a truck having a chassis, wheels or tracks, a cab and a motor. Alternately, the vehicle 16 may be non-propelled and merely towed by a tractor or other vehicle. The vehicle 16 houses all of the operative elements of the apparatus 10 as well as suitable controls, drive means, etc. for operating such elements in the manner and method described below.

By way of background, the apparatus 10 is employed to excavate and backfill a utility cut 12 formed in a section of pavement 14. The utility cut 12 is formed by utility companies which dig a deep trench, from three to 30 feet deep, in the pavement and underlying rock and base material to insert or repair utility lines, not shown, located below the surface of the pavement 14. The cross section of the utility cut 12 may have any desired shape depending upon the nature of the repair and may be a small section as shown in FIG. 1 or an elongated trench running miles parallel to the curb adjacent the pavement 14. It should be understood that the pavement 14 may comprise any suitable pavement surface, such as a road, sidewalk, parking lot, etc.

As shown in FIG. 2, a typical utility cut 12 is formed in the pavement 14. The pavement 14 typically includes an upper pavement section 18 formed of concrete, asphalt or an asphalt coat over an underlying concrete or brick base, and a compacted, granular sub-grade or base section 20 positioned above an earth or parent section 22. The utility cut 12 extends completely through the upper pavement section 18 and at least through a substantial portion of the compacted, sub-grade section 20. In most cases, the utility cut 12 will extend a considerable distance into the parent section 22, as shown in FIG. 2.

In forming the utility cut 12, the upper pavement section 18 is broken by suitable means, such as a hydraulic or mechanical shovel, jackhammer, etc., to break and loosen the upper pavement section and the underlying base 20 into smaller sections or particles. Such particles should have a rough diameter of less than six inches so as to be able to be suctioned away from the utility cut 12 by the apparatus 10.

Figure 3:
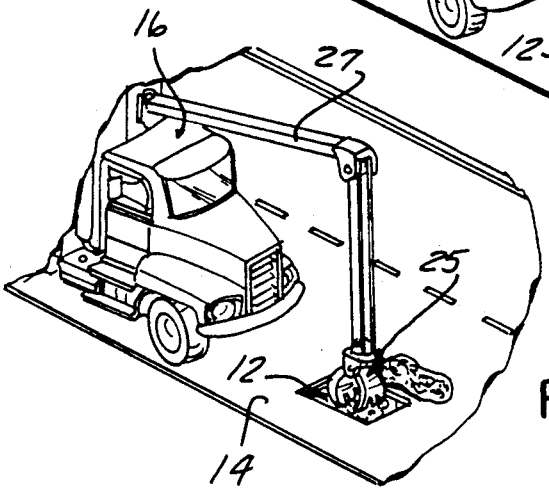
FIG. 3 is a perspective view of another embodiment of the apparatus of the present invention.

As shown in FIGS. 1 and 2, the apparatus 10 includes means, denoted in general by reference number 24, for transferring a quantity of broken pavement 18, underlying base material 20 and parent earth 22 from the utility cut 12. In a preferred embodiment, the transferring means 24 comprises a blower 26 mounted on the vehicle 16 which is connected to an elongated hose 28. The hose 28 is mounted on and pivotally extends outward from the vehicle 16 as shown in FIGS. 1 and 2. A movable and, optionally, a telescoping beam 30 is attached to the rigid structure of the vehicle 16 and supports the hose 28. The inlet end 32 of the hose 28 is movably positionable relative to the utility cut 12 to suction up and remove loose particles from the utility cut 12 or material piled adjacent the utility cut 12 at the site. Alternately, as shown in FIG. 3, the transferring means could be a clam shell or scoop-type shovel 25 mounted on a hydraulic boom 27 fixed to the vehicle 16. The excavated material is placed by the shovel 25 in the vehicle 16 as described hereafter. Further, rather than removing material directly from a utility cut, material in a pile adjacent the utility cut which has been previously excavated could be picked up by the transferring means.

The particulate material removed from the utility cut 12 are carried by the removing means 24 to a means 34 for separating the removed particles to exclude particles above a predetermined size. The separating means 34 includes a bin or chamber 35 mounted on the vehicle 16 which is disposed in communication with the discharge end of the hose 28. The particulate material discharged from the hose 28 falls into the bin 35 where it strikes a screen 36. The screen 36 is preferably movably mounted within the bin 35 and is vibrated by a suitable drive source, not shown. The screen 36 is disposed at an angle with respect to the horizontal such that larger particles having a diameter or size greater than the opening or mesh size of the screen 36 fall by gravity down the screen 36 into the lower portion of the bin 35.

It should be noted that the use of a separating means is optional and is not required if the particles removed from the utility cut 12 are sufficiently small in size. Further, such particles could be directed through a crusher, described below, to reduce their size.

Particles having a size less than the opening or mesh size of the screen 36 pass through the screen and fall onto a conveying means 38 which is also mounted within the bin 35. The conveyor means 38 is also disposed at an angle to horizontal and extends upward from the bottom of the bin 35 to an upper, rearward extending end. Suitable lifting surfaces or carriers 40 are spaced along the length of the conveyor 38 for trapping and carrying the loose particulate material from the bin 35 upon rotation and movement of the traveling surface or belt of the conveyor 38. An air type ballon sealer, not shown, is mounted about the discharge end of the conveyor 38 to seal the conveyor 38 when the blower 26 is in operation.

Optionally, a means 42 for crushing the larger particulate material may be employed so as to reduce such larger particles to the desired smaller size. The crusher means 42 is mounted within the bin 35 and may be of any suitable type, such as pivotal jaws, which move together under force to crush particles located therebetween and to break such particles down into a smaller size. The crusher 42 is located below the bottom edge of the screen 36 so as to receive the larger particulate material therefrom. The crusher 42 may also receive particles directly from the discharge end of the hose 28. The smaller particles exiting from the crusher 42 fall onto a second conveyor means 44 which extends along the bottom of the bin 35. Such particles falling onto the second conveyor 44 are transported to the first conveyor 38 for discharge from the bin 35.

The discharge end of the conveyor 38 opens into a hopper means 46 for storing the particulate material. The hopper means 46 is mounted on the vehicle 16 and may have a closed or open top. A suitable transport means, such as a rotating screw 48, is mounted in the bottom of the hopper 46 for moving the particulate material out of the hopper 46 as described hereafter. The discharge end 50 of the hopper 46 opens to a mixing means 52 which is mounted on the rear end of the vehicle 16. The mixing means 52 may comprise any suitable mixing means, such as a pug mill, for mixing various components supplied thereto.

A pair of reservoirs or tanks 54 and 56 are mounted on the vehicle 16 above the mixing means 52. The reservoirs 54 and 56 respectively carry quantities of a binder material, such as cement, flyash or the like, and water. The binder material is preferably finely divided particulate material which increases to the flowable nature and compaction of the filler material and, further, hardens over time to provide strength to the filler material applied to the utility cut. An additional reservoir or holding tank, not shown, may be mounted on the vehicle 16 for storing a suitable chemical used to stabilize clay soils. Such a chemical is sold under the trademark "Perma-Soil" by Charles Motor Works, Inc.

Suitable outlets, not shown, are provided along with controls, such as valves, for inputting a predetermined quantity of cement, flyash or the like, and water from the reservoirs 54 and 56 and/or the additional reservoir into the mixing means or chamber 52 to mix such components with the particulate material discharged from the hopper 46. The mixing of the water, binder material and particulate material in the mixing means or chamber 52 forms a fluid, settable, unshrinkable filler base material, such as that disclosed in U.S. Pat. No. 4,815,891, issued to the same inventor as the present invention. Further details concerning the formation and use of such filler material may be had by referring to U.S. Pat. No. 4,815,891, the contents of which are incorporated herein in its entirety by reference.

Finally, an elongated conduit 61 is connected to the discharge end of the mixing means 52 and forms a part of the mixing means 52. The conduit 61 carries the filler material to a discharge nozzle 62 wherein it is applied to the utility cut 12.

For use of the apparatus 10 in below-freezing ambient temperatures, some or all of the bin 34, hopper 46, mixing means 52, reservoirs 54 and 56, conduit 61, and the interconnecting conduits may be heated by electric means or by using LPG or natural gas.

It will be noted that although two separate utility cuts are illustrated in FIG. 2, it is preferred that the material excavated and removed from the utility cut 12, the right-most utility cut shown in FIG. 2, be employed and reapplied to the same utility cut. The illustration of two separate utility cuts in FIG. 2 is for purposes of clarity to show the reapplication of the filler material comprised of water, cement, or flyash or the like, and the separated material removed from the utility cut back into a utility cut. However, such excavated material could optionally be employed in a different utility cut in the same general section of pavement.

The filler material 64 is poured from the nozzle 62 into the utility cut 12 up to a desired distance below grade level. After the filler material sets to a hardened state, a top layer of concrete or asphalt may be applied over the set and hardened filler material 64 contiguous with the surrounding, existing pavement 14.

In order to reduce the setting time required to harden the filler material 64 to a set, hard state, an optional heater means, not shown, may be mounted on the vehicle 16 or in a separate vehicle towed by the vehicle 16. The use and function of such heating means is described in U.S. Pat. No. 4,815,891. The contents of this patent relating to the heater means are incorporated herein by reference. Generally, however, the heater means supplies heat onto the upper surface of the filler material which causes the filler material to set to a hardened state within a short period of time.

Further, a suction pump, not shown, of any suitable type, such as a well-point pump, may also be mounted on the vehicle at any suitable location or used as a separate device apart from the vehicle to suction water from the bottom of the utility cut 12 before the filler material is discharged into the utility cut 12 as well as to suction water from the filler material 64 or surface water above the filler material 64 after the filler material 64 has been discharged into the utility cut. This allows a faster set-up time of the filler material 64.

In performing the method of the present invention, the apparatus 10 is positioned in proximity with the utility cut 12. The hose 28 is positioned over the utility cut 12 and the broken pavement, base 20 and portions of the underlying parent material 22 are suctioned from the utility cut 12 or from a stock pile adjacent to the opening which has been previously excavated. Such particles are discharged into the bin 34 in the vehicle 16 wherein they are separated, with particles having a diameter or size smaller than a predetermined size passing through the screen 36 onto a conveyor 38 wherein they are discharged from the bin 34 into a temporary storage hopper 46. Larger particles pass from the screen 36 into the bottom of the bin 34. Optionally, a crusher means 42 may be employed in the bin 34 for reducing such larger particles to the desired smaller size. Such particles may then be conveyed from the bin 34 into the hopper 46.

The separated particulate material removed from the utility cut 12 is then mixed with predetermined quantities of water and cement to form a fluid, settable, unshrinkable filler material which is discharged back into the same utility cut 12 up to a predetermined level below grade. The filler material 64 is then allowed to harden to a set state capable of carrying loads.

In summary, there has been disclosed a unique method and apparatus for restoring utility cuts in sections of pavement in which the utility cuts will have a strength commensurate with the strength of the existing pavement base. All of the operative components used to recycle the excavated material are arranged for use directly at the utility cut site which minimizes transport and repair costs as well as providing a quick and efficient utility cut repair method.

The method and apparatus of the present invention recycles the excavated material from a utility cut by adding quantities of water and a binder material, such as cement, flyash or the like, to the excavated material to form a fluid, settable, unshrinkable filler material which is then restored to the utility cut to form a suitable, self-compacted base for receiving a parent layer of concrete, asphalt or combinations thereof.

What is claimed is:

1. A method for refilling an opening in a section of pavement and through the underlying pavement base material comprising the steps of:

transferring a quantity of broken pavement and underlying base material from an opening in the pavement;

mixing the transferred material with predetermined quantities of water and a binder material to form a fluid, unshrinkable, settable filler mixture; and applying the filler mixture to the opening in the section of pavement.

2. The method of claim 1 wherein the step of transferring the material further includes the step of:

suctioning the broken pavement and base material from the opening.

3. The method of claim 1 wherein the step of transferring the material further includes the step of picking up a quantity of broken pavement and underlying base material which has been previously excavated from the opening in the pavement.

4. The method of claim 1 further including the step of:

temporarily storing the transferred material prior to mixing the transferred material with water and cement.

5. The method of claim 1 further including the step of:

heating the filler mixture after the mixture has been applied to the opening in the pavement to cause the filler mixture to set to a hardened state.

6. The method of claim 1 further including the step of:

crushing the removed material to a smaller particle size prior to mixing such particles with water and binder material.

7. The method of claim 1 further including the step of:

separating the transferred material to exclude particles above a predetermined size; and wherein the step of mixing further comprises the step of mixing the separated material of a predetermined particle size with predetermined quantities of water and cement.

8. The method of claim 7 further including the step of:

crushing the separated material having a particle size greater than the predetermined size prior to mixing such material with water and binder material.

9. The method of claim 1 wherein the step of transferring the material includes the step of scooping the material from the opening in the pavement.

10. The method of claim 1 wherein:

all of the steps are performed on one movable vehicle.

11. The method of claim 1 further including the step of:

removing water from the filler material after the filler material has been applied to the opening in the section of pavement.

12. An apparatus for refilling an opening in a section of pavement and through the underlying pavement base material comprising:

means for transferring broken pavement and the underlying base material from an opening in a section of pavement;

hopper means, mounted on a vehicle, for storing the removed material;

mixing means, including a mixing chamber disposed in communication with the hopper means, for mixing the removed material with predetermined quantities of water and a binder material to form a fluid, unshrinkable, settable filler mixture; and means, disposed in communication with the mixing chamber, for applying the fluid, filler mixture to the opening in the section of pavement.

13. The apparatus of claim 12 wherein the transferring means comprises:

a vacuum source mounted on the vehicle; and a conduit connected to the vacuum source and opening to the hopper means at one end.

14. The apparatus of claim 12 wherein the transferring means comprises:

a shovel movably mounted on the vehicle.

15. The apparatus of claim 12 further including:

heater means for heating the fluid, filler mixture after the filler mixture has been applied to the opening in the section of pavement.

16. The apparatus of claim 12 wherein:

the transferring means, the hopper means, the mixing means, and the applying means are mounted on a single vehicle.

17. The apparatus of claim 16 wherein the vehicle includes motor power means for operating the apparatus.

18. The apparatus of claim 12 further including:

crusher means, mounted on the vehicle, for crushing the transferred material to a smaller size.

19. The apparatus of claim 12 further including:

means, disposed in communication with the transferring means, for separating the transferred material according to particle size to exclude particles above a predetermined size; and the mixing means mixing the separated material less than the predetermined particle size with predetermined quantities of water and cement.

20. The apparatus of claim 19 wherein the separating means comprises:

a bin mounted on the vehicle;

screen means mounted in the bin and having a plurality of openings to pass particles of less than a predetermined size therethrough; and means, mounted within the bin, for conveying the passed particles of less than a predetermined size to the hopper means.

21. The apparatus of claim 19 further including:

crusher means, mounted on the vehicle and disposed in communication with the separating means, for crushing the material having a particle size larger than the predetermined particle size to a smaller size.

22. The apparatus of claim 12 further including:

means, mounted on the vehicle, for separately storing quantities of water and the binder material, the storing means being selectively connectable to the mixing chamber.

23. The apparatus of claim 12 further including:

means for removing water from the filler material after the filler material have been reapplied to the opening in the section of pavement.

24. An apparatus for refilling an opening in a section of pavement and through the underlying pavement base material comprising:

a single, movable vehicle;

motive power means, mounted on the vehicle, for operating the apparatus;

a vacuum source mounted on the vehicle;

a conduit coupled to the vacuum source and having first and second ends, the first end being movingly positionable with respect to the vehicle to receive broken pavement and underlying base material from the opening under a vacuum;

a bin mounted on the vehicle and disposed in communication with the second end of the conduit;

a screen mounted in the bin, the screen having a plurality of openings of a predetermined size to pass particles of less size therethrough;

a conveyor mounted in the bin and disposed to receive particles passed through the screen, the conveyor having a discharge end;

a hopper mounted on the vehicle and receiving particles from the discharge end of the conveyor, the hopper having an outlet;

first and second reservoirs mounted on the vehicle for storing quantities of water and a binder material, respectively, each of the first and second reservoirs having an outlet;

a mixer means, mounted on the vehicle, for mixing material received from the hopper outlet and the outlets of the first and second reservoirs and forming a fluid, unshrinkable, settable, filler mixture; and a discharge nozzle coupled to the mixer means, for discharging the fluid mixture into the opening in the section of pavement.

* * * * *